US009847591B2

(12) United States Patent
Glick et al.

(10) Patent No.: US 9,847,591 B2
(45) Date of Patent: Dec. 19, 2017

(54) ELECTRIC TERMINAL ASSEMBLY

(71) Applicant: Lear Corporation, Southfield, MI (US)

(72) Inventors: Michael Glick, Farmington Hills, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/660,234

(22) Filed: Mar. 17, 2015

(65) Prior Publication Data

US 2016/0028169 A1 Jan. 28, 2016

Related U.S. Application Data

(60) Provisional application No. 62/027,361, filed on Jul. 22, 2014.

(51) Int. Cl.

| | |
|---|---|
| ***H01R 13/18*** | (2006.01) |
| *H01R 9/03* | (2006.01) |
| *H01R 13/11* | (2006.01) |

(52) U.S. Cl.

CPC ..... *H01R 13/18* (2013.01); *H01R 9/03* (2013.01); *H01R 13/111* (2013.01)

(58) Field of Classification Search

CPC ..... H01R 13/114; H01R 13/18
USPC ..... 439/843, 845, 839
See application file for complete search history.

(56) References Cited

U.S. PATENT DOCUMENTS

| | | | |
|---|---|---|---|
| 4,040,713 | A | 8/1977 | Könnemann |
| 4,540,234 | A | 9/1985 | Könnemann et al. |
| 4,540,235 | A | 9/1985 | Lolic |
| 4,583,812 | A | 4/1986 | Gross, Jr. et al. |
| 4,932,877 | A | 6/1990 | Zinn |
| 5,007,865 | A | 4/1991 | Jakobeit |
| 5,064,379 | A | 11/1991 | Ryll et al. |
| 5,080,604 | A | 1/1992 | Rider et al. |
| 5,147,230 | A | 9/1992 | Plyler et al. |
| 5,334,058 | A | 8/1994 | Hotea |

(Continued)

FOREIGN PATENT DOCUMENTS

| | | | |
|---|---|---|---|
| CN | 202094365 | U | 12/2011 |
| CN | 103996918 | A | 8/2014 |

(Continued)

OTHER PUBLICATIONS

English Translation DE10019241 A1.*

(Continued)

*Primary Examiner* — Tulsidas C Patel
*Assistant Examiner* — Marcus Harcum
(74) *Attorney, Agent, or Firm* — MacMillan, Sobanski & Todd, LLC

(57) ABSTRACT

An electric terminal assembly includes a conductor. The conductor has a conductor body and a plurality of contact arms that extend from the conductor body in an outward direction to respective arm ends. The contact arms are located around a terminal axis. The electric terminal assembly also includes a cap fixed relative to the conductor. The cap is located farther from the conductor body in the outward direction than the arm ends. The cap defines a cap opening that the terminal axis extends through. The cap is located farther from the conductor body in the outward direction than the arm ends, and the cap is closer to the terminal axis than the arm ends.

15 Claims, 7 Drawing Sheets

(56) References Cited

U.S. PATENT DOCUMENTS

| | | | | |
|---|---|---|---|---|
| 5,413,506 | A | 5/1995 | Thompson | |
| 5,415,571 | A | 5/1995 | Lutsch | |
| 5,437,566 | A | 8/1995 | Zinn et al. | |
| 5,558,547 | A | 9/1996 | Breitschaft et al. | |
| 5,573,434 | A | 11/1996 | Ittah et al. | |
| 5,616,717 | A | 4/1997 | Grozinger | |
| 5,654,972 | A | 8/1997 | Kuroiwa et al. | |
| 5,664,972 | A | 9/1997 | Zinn et al. | |
| 5,755,599 | A | 5/1998 | Hotea | |
| 5,868,590 | A | 2/1999 | Dobbelaere | |
| 5,941,740 | A | 8/1999 | Neuer et al. | |
| 5,975,964 | A | 11/1999 | Seko et al. | |
| 5,993,253 | A | 11/1999 | Sai | |
| 6,224,428 | B1 | 5/2001 | Chen et al. | |
| 6,394,858 | B1 * | 5/2002 | Geltsch | H01R 13/187 439/843 |
| 6,402,571 | B1 | 6/2002 | Muller et al. | |
| 6,475,040 | B1 | 11/2002 | Myer et al. | |
| 7,252,559 | B1 | 8/2007 | Morello et al. | |
| 7,278,891 | B2 | 10/2007 | Cvasa et al. | |
| 7,556,542 | B2 | 7/2009 | Lischeck et al. | |
| 7,578,694 | B2 | 8/2009 | Takahashi et al. | |
| 7,766,706 | B2 | 8/2010 | Kawamura et al. | |
| 7,892,050 | B2 | 2/2011 | Pavlovic et al. | |
| 7,988,481 | B2 | 8/2011 | Bethurum et al. | |
| 8,057,261 | B1 | 11/2011 | DeSio et al. | |
| 8,282,426 | B2 | 10/2012 | Zweigle | |
| 8,339,235 | B2 | 12/2012 | Beckert et al. | |
| 8,366,497 | B2 | 2/2013 | Glick et al. | |
| 8,475,220 | B2 | 7/2013 | Glick et al. | |
| 8,678,867 | B2 | 3/2014 | Glick et al. | |
| 8,695,368 | B2 * | 4/2014 | Yoon | F25D 21/04 62/273 |
| 2001/0019924 | A1 | 9/2001 | Heimueller | |
| 2003/0067242 | A1 | 4/2003 | Konishi et al. | |
| 2006/0040555 | A1 | 2/2006 | Chen et al. | |
| 2010/0311280 | A1 | 12/2010 | Tin et al. | |
| 2012/0129407 | A1 | 5/2012 | Glick et al. | |
| 2012/0282797 | A1 * | 11/2012 | Mott | H01R 13/111 439/357 |
| 2013/0045630 | A1 | 2/2013 | Natter | |
| 2013/0090009 | A1 | 4/2013 | Zhao | |
| 2013/0130530 | A1 | 5/2013 | Casses et al. | |
| 2013/0330968 | A1 | 12/2013 | Duan | |
| 2014/0235113 | A1 | 8/2014 | Glick et al. | |

FOREIGN PATENT DOCUMENTS

| | | | |
|---|---|---|---|
| DE | 10019241 | A1 | 10/2001 |
| DE | 69934065 | T2 | 6/2007 |
| DE | 10021972 | B4 | 3/2009 |
| DE | 19961544 | B4 | 3/2009 |
| EP | 0282624 | A2 | 9/1988 |
| GB | 2323221 | A | 9/1998 |
| JP | 10125378 | A | 5/1998 |
| JP | 2011238399 | A | 11/2011 |
| WO | 89/05531 | A1 | 6/1989 |
| WO | 2014/063142 | A1 | 4/2014 |

OTHER PUBLICATIONS

PCT International Search Report and the Written Opinion, Application No. PCT/US2013/065900 filed Oct. 21, 2013, dated Feb. 12, 2014.

* cited by examiner

ELECTRIC TERMINAL ASSEMBLY

CROSS-REFERENCE TO RELATED APPLICATIONS

This application claims the benefit of U.S. Provisional Application No. 62/027,361, filed Jul. 22, 2014, the disclosure of which is incorporated herein by reference.

BACKGROUND OF THE INVENTION

This invention relates in general to a female electric terminal assembly. More specifically, this invention relates to a female electric terminal assembly that includes features to protect contact arms of the female electric terminal from damage.

Electric connectors are used in a variety of situations where it is desirable to have an electric connection between components. For example, electric connectors are used to complete electrical circuits between components in a power distribution box or to connect a wiring harness to an electrical device.

Electric connectors typically include resilient, electrically conductive terminals that are adapted to engage a corresponding terminal. In some cases, it is desirable to prevent accidental contact with the terminals in order to prevent damage to the terminals and to avoid unintended grounding of electric current. It would be advantageous to have an improved type of terminal protection.

SUMMARY OF THE INVENTION

This invention relates to an electric terminal assembly. The electric terminal assembly includes a conductor. The conductor has a conductor body and a plurality of contact arms that extend from the conductor body in an outward direction to respective arm ends. The contact arms are located around a terminal axis. The electric terminal assembly also includes a cap fixed relative to the conductor. The cap is located farther from the conductor body in the outward direction than the arm ends. The cap defines a cap opening that the terminal axis extends through. The cap is located farther from the conductor body in the outward direction than the arm ends and the cap is closer to the terminal axis than the arm ends.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
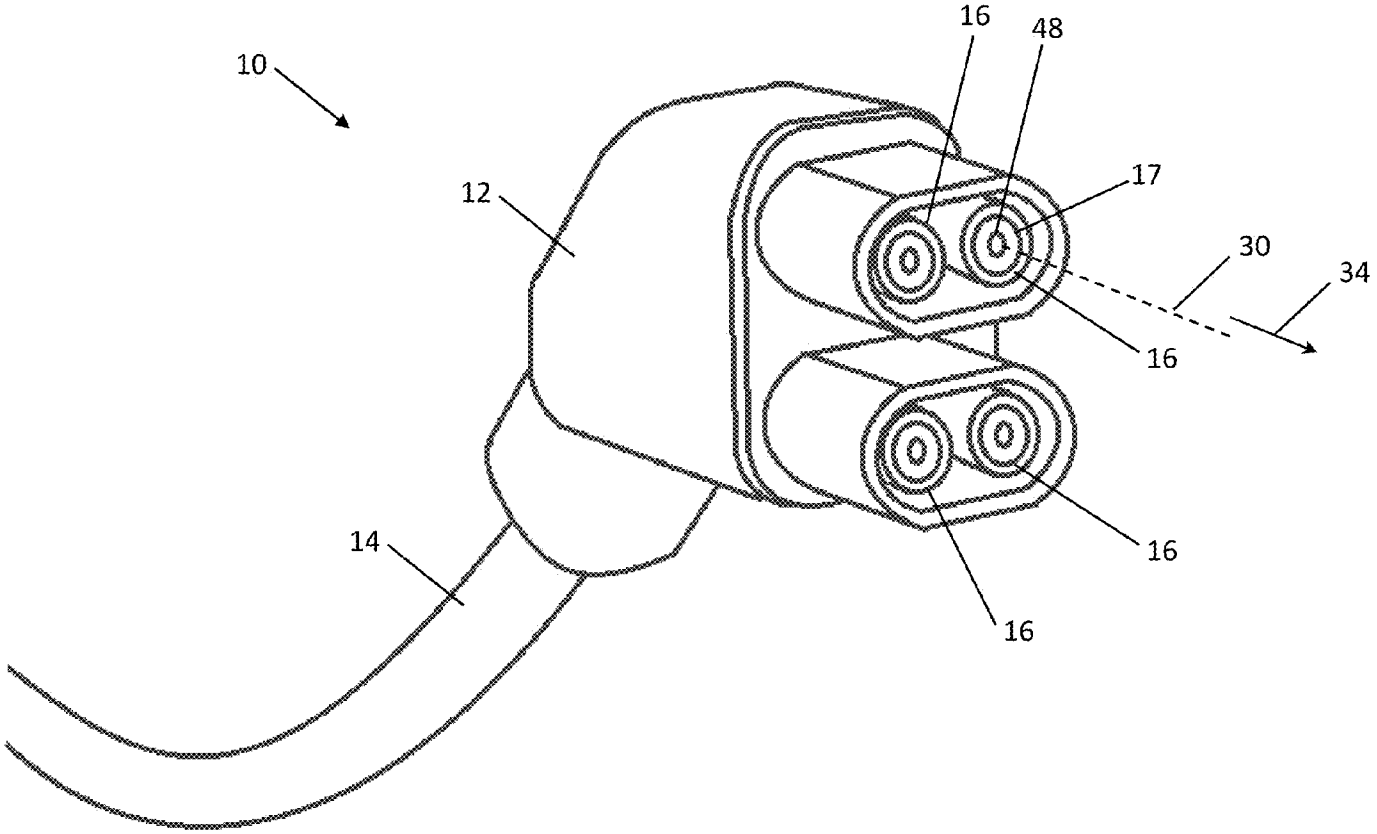
FIG. 1 is a perspective view of an electric connector assembly that includes a plurality of electric terminal assemblies.

Referring now to the drawings, there is illustrated in FIG. 1 an electric connector assembly, indicated generally at 10. The electric connector assembly 10 includes a housing 12 that is connected by a wire bundle 14 to a component, such as a power source (not shown). The illustrated housing 12 is made of plastic, but may be made of any desired material. The electric connector assembly 10 is adapted to connect the component to powered equipment (not shown) in a conventional manner. The illustrated electric connector assembly 10 includes a plurality of terminal houses 16, each of which defines a terminal opening 17. The illustrated terminal houses 16 are made of plastic, but may be made of any desired material. Each of the terminal houses 16 contains an electric terminal assembly, not shown in FIG. 1 but indicated generally at 18 hereinafter and which will be described in detail below. Each of the electric terminal assemblies 18 is electrically connected to a wire (not shown) in the wire bundle 14. The electric connector assembly 10 illustrates one environment in which the electric terminal assembly 18 described herein may be used. However, the electric terminal assembly 18 may be used in any desired application.

Figure 2:
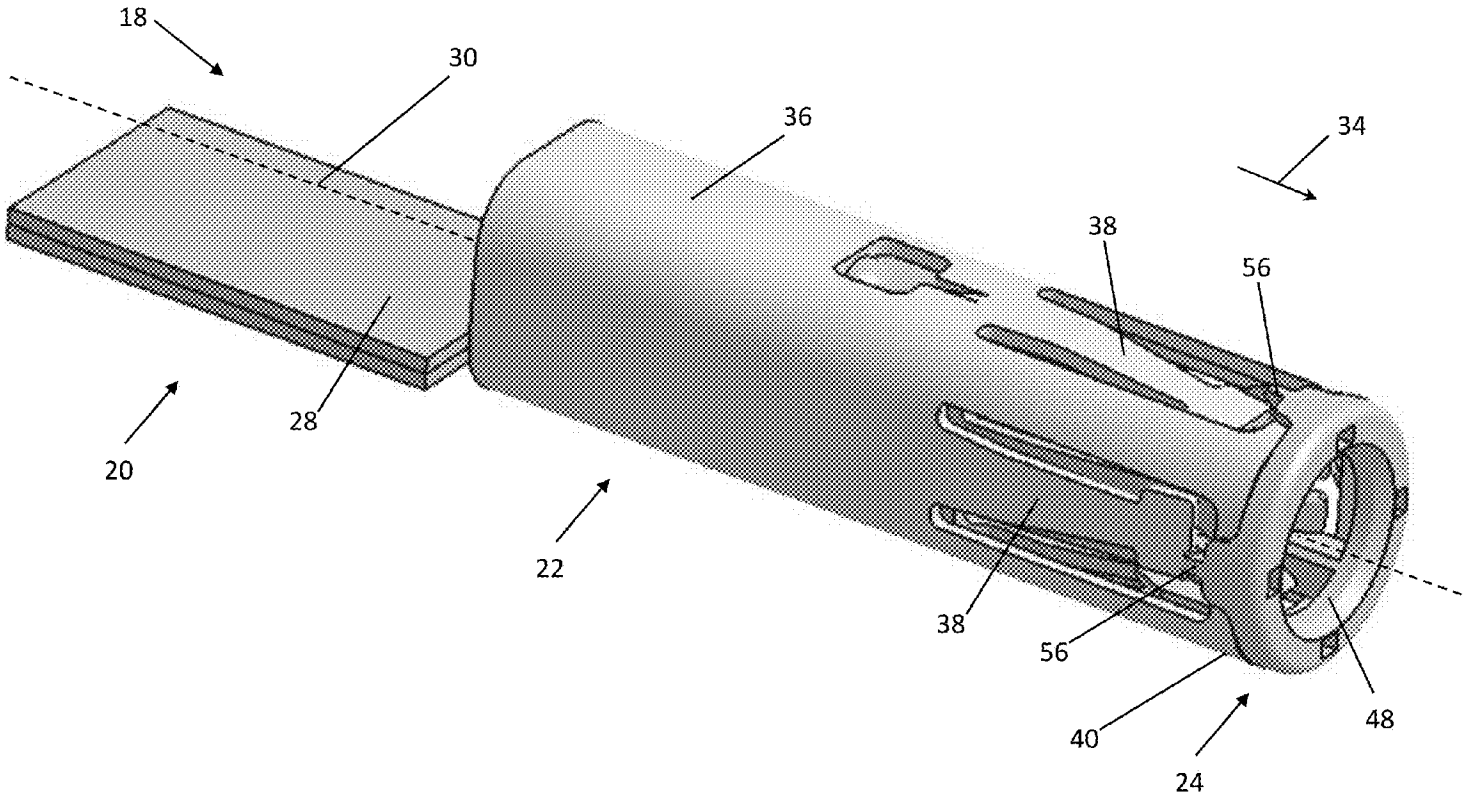
FIG. 2 is an enlarged perspective view of one of the electric terminal assemblies in the electric connector assembly shown in FIG. 1.
Figure 3:
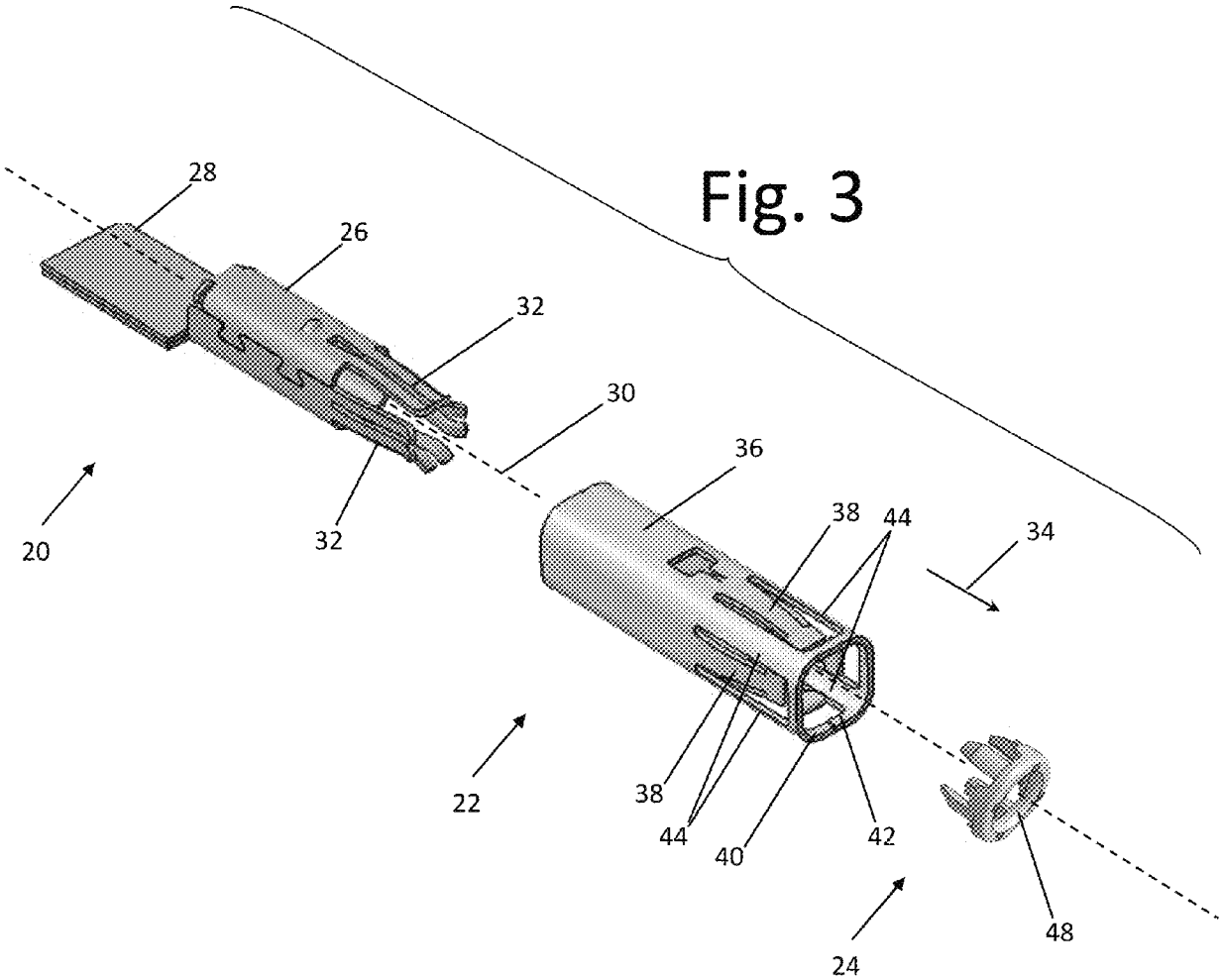
FIG. 3 is an exploded, perspective view of the electric terminal assembly shown in FIG. 2.

Referring now to FIG. 2, the electric terminal assembly 18 is shown. An exploded view of the electric terminal assembly 18 is shown in FIG. 3. The electric connector assembly 10 includes a plurality of identical electric terminal assemblies 18, and only one will be described in detail. However, the electric connector assembly 10 may include electric terminal assemblies 18 having different dimensions or configurations, if desired. The electric terminal assembly 18 includes a conductor portion indicated at 20, a spring portion indicated at 22, and a cap portion indicated at 24.

Figure 4:
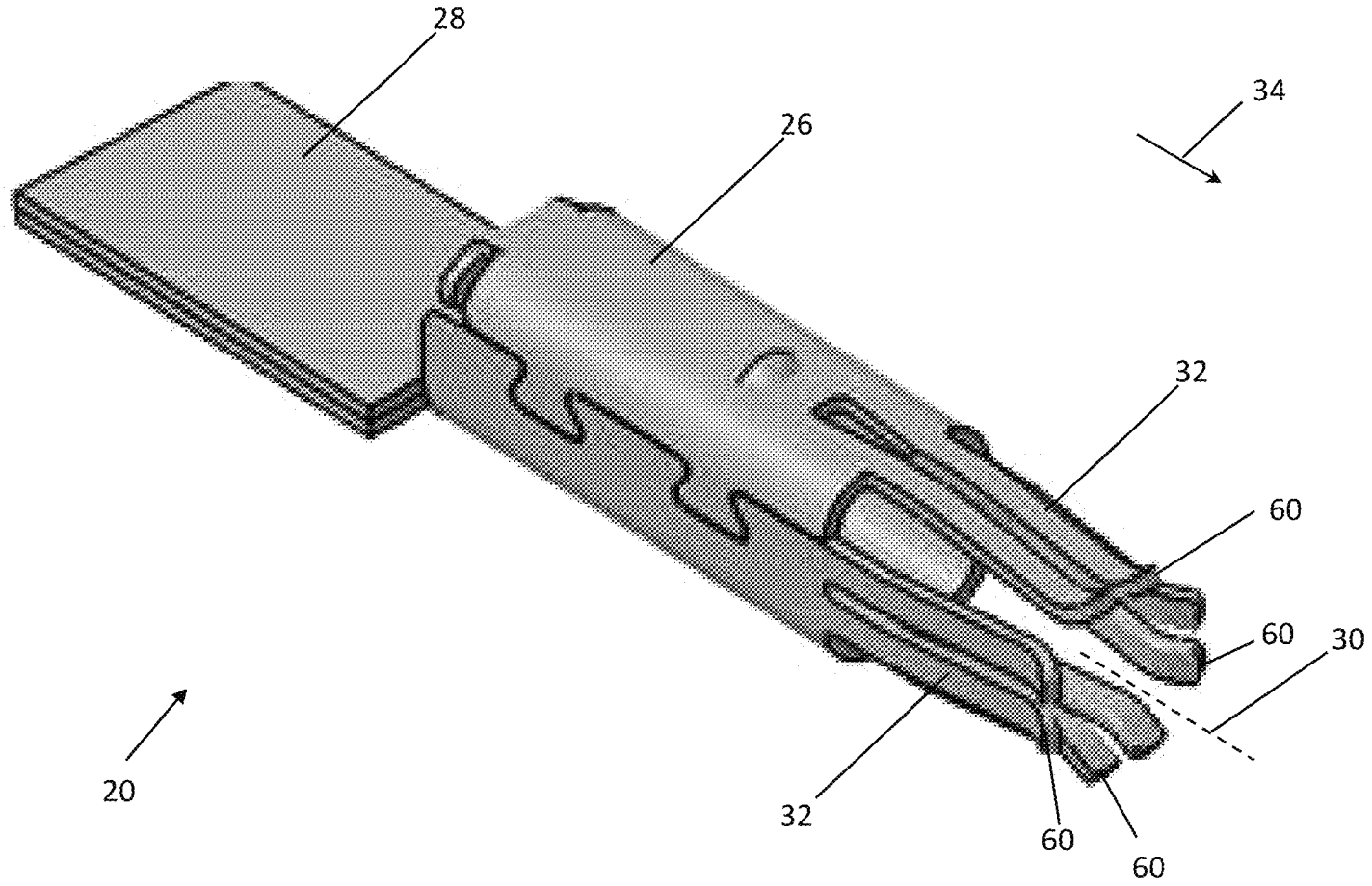
FIG. 4 is an enlarged perspective view of a conductor portion of the electric terminal assembly shown in FIGS. 2 and 3.

Referring to FIG. 4, the conductor portion 20 is shown in greater detail. The illustrated conductor portion 20 is made from folded sheet copper, but may be made of any desired material or process. The conductor portion 20 includes a conductor body 26 and an attached termination portion 28. A wire (not shown) is crimped to the termination portion 28. However, the wire may be attached to the termination portion 28 by any desired fastener or method. The illustrated conductor body 26 has a generally square cross-sectional shape and defines a terminal axis 30. The conductor body 26 may have any other desired shape. The conductor portion 20 includes a plurality of contact arms 32 that extend from the conductor body 26 in an outward direction 34. The illustrated contact arms 32 extend from all four sides of the generally square-shaped conductor body 26, but may be arranged to extend from the conductor body 26 in any desired configuration. The contact arms 32 are disposed around the terminal axis 30 and are adapted to engage a corresponding terminal, as will be described below. The contact arms 32 extend from the conductor body 26 in the outward direction 34 to respective arm ends 60.

Figure 5:
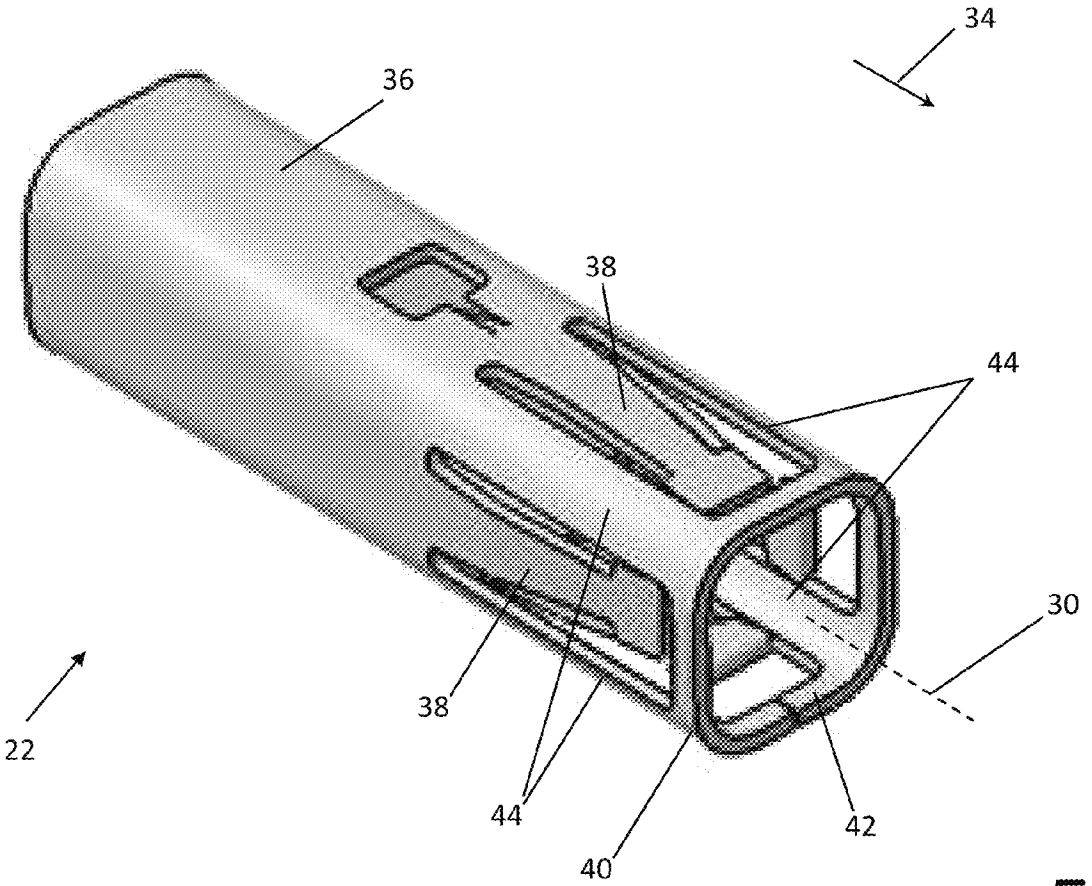
FIG. 5 is an enlarged perspective view of a spring portion of the electric terminal assembly shown in FIGS. 2 and 3.

Referring to FIG. 5, the spring portion 22 is shown in greater detail. The illustrated spring portion 22 is made from folded sheet stainless steel, but may be made of any desired material or process. The spring portion 22 includes a spring body 36 that has a generally square cross-section shape. The spring body 36 is adapted to fit around the conductor body 26 when the electric terminal assembly 18 is assembled. Thus, the interior of the illustrated conductor body 26 generally corresponds to the dimensions of the exterior of the conductor body 26. However, the spring body 36 may have any desired shape. The spring portion 22 includes a plurality of spring arms 38 that extend from the spring body 36 in the outward direction 34. The illustrated spring arms 38 extend from all four sides of the generally square-shaped spring body 36, but may be arranged to extend from the spring body 36 in any desired configuration. The spring arms 38 are adapted to engage the contact arms 32 and bias them toward the terminal axis 30. The spring portion 22 serves in increase the force with which the contact arms 32 engage the corresponding connector.

The illustrated electric terminal assembly 18 also includes a shroud 40. The illustrated shroud 40 is an integral part of the spring portion 22 and is made of stainless steel. However, the shroud 40 may be part of the conductor portion 20 or may be a separate component if desired, and may be made of any desired material. The illustrated shroud 40 has a generally square cross-sectional shape, but may have any desired shape. The shroud 40 defines a shroud opening 42 and the terminal axis 30 passes through the shroud opening 42. The shroud 40 extends farther from the spring body 36 in the outward direction 34 than the spring arms 38. The shroud 40 is connected to the spring body 36 by a plurality of side walls 44. The illustrated spring includes four side walls 44, but may include any desired number of side walls 44.

Figure 7:
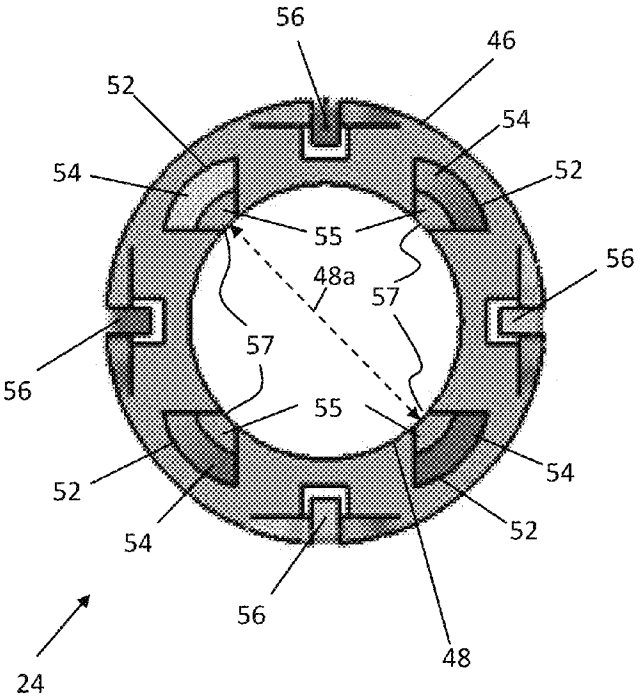
FIG. 7 is an end elevational view of the cap portion shown in FIG. 6.
Figure 6:
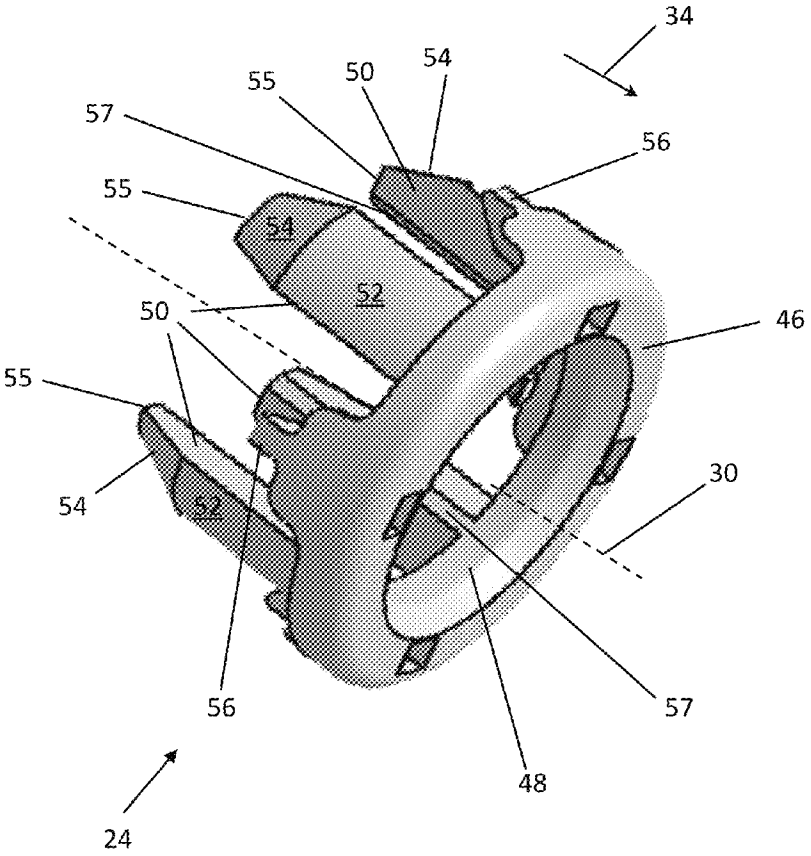
FIG. 6 is a perspective view of a cap portion of the electric terminal assembly shown in FIGS. 2 and 3.

Referring to FIG. 6 and FIG. 7, the cap portion 24 is shown in greater detail. The illustrated cap portion 24 is made from molded plastic, but may be made of any desired material or process. The cap portion 24 includes a cap body 46 that has a generally circular cross-sectional shape, though the cap body 46 may have any desired shape. The cap body 46 defines a cap opening 48 and the terminal axis 30 passes through the cap opening 48. The cap portion 24 includes a plurality of cap guides 50 on the cap body 46. The cap guides 50 serve to assist with proper alignment of the cap portion 24 with the spring portion 22 when the terminal assembly 18 is assembled, as will be described below. The illustrated cap portion 24 includes four cap guides 50, but may include any desired number of cap guides 50. The illustrated cap guides 50 are bosses that extend from the cap body 46 opposite the outward direction 34.

Referring to FIG. 7, an end view of the cap portion 24 is shown looking along the terminal axis 30 in the outward direction 34. The illustrated cap guides 50 include outer cap guide surfaces 52 that define have arcuate surfaces. The outer surfaces 52 of the cap guides 50 cooperate to define a generally square-shaped configuration that corresponds to the interior shape of the shroud 40. When the terminal assembly 18 is assembled, a cap guide 50 is positioned in each corner of the shroud 40, and each cap guide surface 52 engages the shroud 40. Each of the cap guides 50 includes a tapered end surface 54. The end surface 54 extends from the respective cap guide surface 52 toward to the terminal axis 30 to respective guide ends 55.

The cap portion 24 also includes a plurality of cap mounts 56 that serve to retain the cap portion 24 on the spring portion 22 when the terminal assembly 18 is assembled. The illustrated cap portion 24 includes four cap mounts 56, but the cap portion 24 may include any desired number of cap mounts 56. The illustrated cap mounts 56 are resilient hooks that extend from the cap body 46 opposite the outward direction 34. The illustrated cap mounts 56 are adapted to initially be deflected by and then engage the shroud 40 when the terminal assembly 18 is assembled. It should be appreciated that while the cap portion 24 has been illustrated as a separate component that is attached to the spring portion 22, the cap portion 24 may be integral with the spring portion 22 if desired. Additionally, it should be appreciated that the cap portion 24 may be attached to the spring portion 22 using any desired fastener or method.

Referring back to FIG. 2, the assembled terminal assembly 18 is shown. The spring body 36 of the spring portion 22 is disposed around the conductor body 26 of the conductor portion 20, and the spring arms 38 are engaged with contact arms 32. Each of the illustrated spring arms 38 applies are applying a force on the respective contact arms 32 to bias them toward the terminal axis 30. Because the spring body 36 is fixed to the conductor body 26, the shroud 40 is fixed relative to the conductor portion 20. The cap portion 24 is attached to the spring portion 22, with the cap mounts 56 engaged with the shroud 40. Therefore, the cap portion 24 is also fixed relative to the conductor portion 20.

Figure 8:
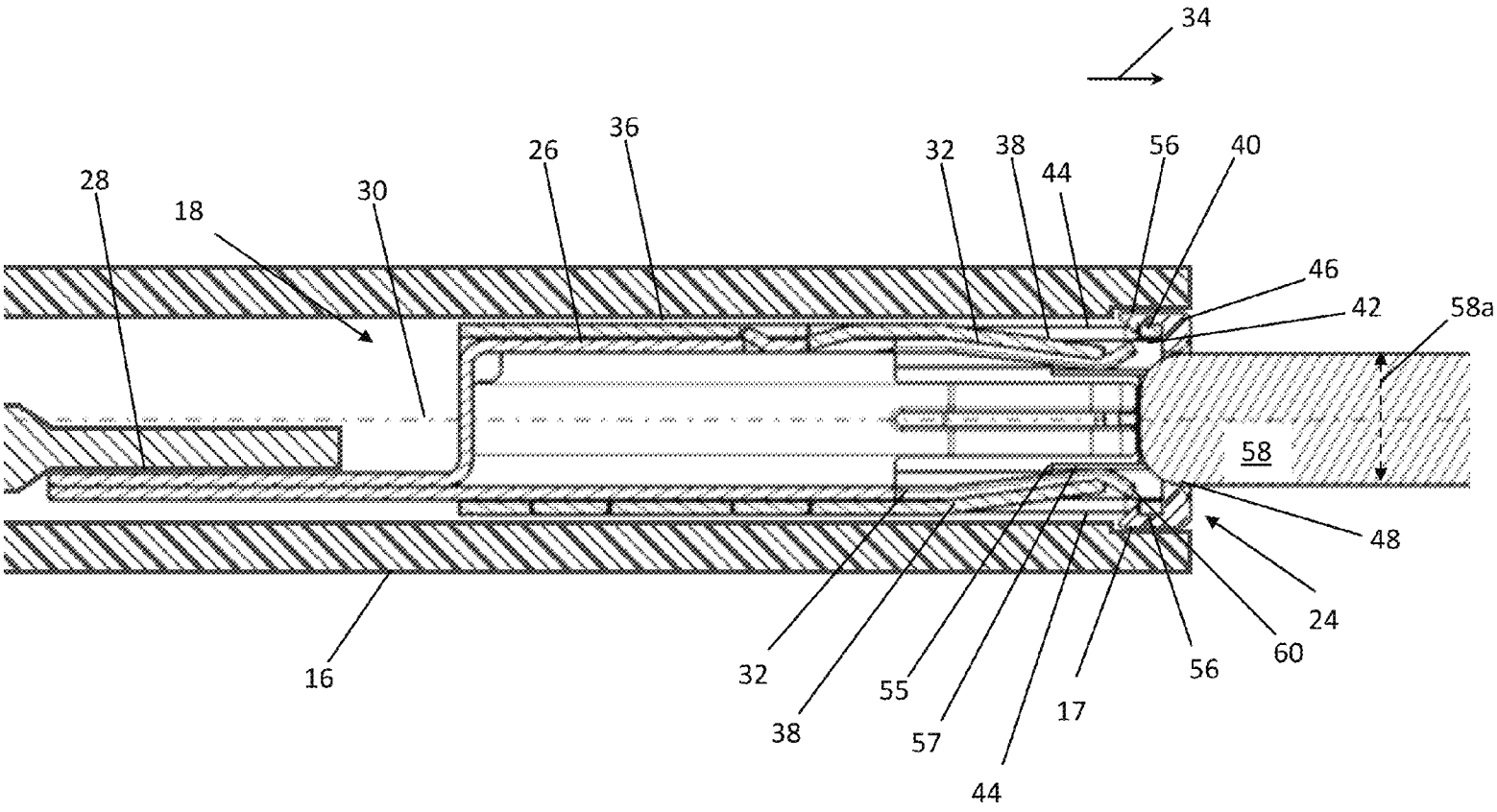
FIG. 8 is an enlarged cross-sectional view of the assembled electric terminal assembly illustrated in FIG. 2 and FIG. 3 initially engaging a corresponding terminal.

Referring now to FIG. 8, a cross-sectional view of the terminal house 16 including the terminal assembly 18 is shown. A corresponding terminal 58 is also shown initially engaging the terminal assembly 18. The illustrated corresponding terminal 58 has a cylindrical shape. However, the corresponding terminal 58 may have any desired shape. As shown, the terminal assembly 18 disposed within the terminal house 16 such that the cap portion 24 is located in the terminal opening 17 defined by the terminal house 16. As best seen in FIG. 1, the terminal opening 17 is generally circular in shape, and the cap opening 48 is co-axial with the terminal opening 17. However, the terminal opening 17 may have any desired shape. As shown in FIG. 7 the cap opening 48 has an opening diameter 48*a* and as shown in FIG. 8, the corresponding terminal 58 has a terminal diameter 58*a*. The opening diameter 48*a* is slightly larger than the terminal diameter 58*a*. It should be appreciated that the shape and size of the cap opening 48 may be different from that shown in order to accommodate the desired corresponding terminal 58.

The cap portion 24 serves as a guide for the corresponding terminal 58 when it engages the terminal assembly 18 and provides protection for the contact arms 32. The shroud 40 is located farther from the conductor body 26 in the outward direction 34 than the arm ends 60. Additionally, the cap portion 24 is located farther from the conductor body 26 in the outward direction 34 than the arm ends 60. Because the corresponding terminal 58 initially passes through the cap opening 48, the corresponding terminal 58 is aligned with the terminal axis 30 and is less likely to engage one of the outer ends 60 of the contact arms 32. Additionally, as shown in FIG. 8, the cap portion 24 extends toward the terminal axis 30 such that the cap portion 24 is closer to the terminal axis 30 than the arm ends 60. This helps to prevent the corresponding terminal 58 from engaging one of the arm ends 60.

As best shown in FIG. 6 and FIG. 7, each of the cap guides 50 also includes a pin guide surface 57. The pin guide surfaces 57 are the surfaces of the respective cap guides 50 that are closest to the terminal axis 30. As best seen in FIG. 7, each of the pin guide surfaces 57 has a circumferentially extending arcuate shape, and opposed pin guide surfaces 57 are separated from each other by a distance equal to the opening diameter 48*a*. Each of the illustrated pin guide surface 57 extends from the cap opening 48 to the respective guide ends 55. The pin guide surfaces 57 serve to keep the corresponding terminal 58 aligned with the terminal axis 30. It should be appreciated that when the corresponding terminal 58 is inserted into the cap portion 24, movement that would take the corresponding terminal 58 out of alignment with the terminal axis 30 will be resisted by the corresponding terminal 58 engaging one or more of the pin guide surfaces 57. As shown in FIG. 8, the illustrated guide ends 55 are located closer to the conductor body 26 in the outward direction 30 than the arm ends 60. Thus, the pin guide surfaces 57 guide the corresponding terminal 58 past the arm ends 60 when the corresponding terminal 58 is mated with the terminal assembly 18.

The illustrated cap portion 24 also provides protection against unintended grounding for the conductor portion 20. If an object other than the corresponding terminal 58 engages the conductor portion 20, there may be an unintended grounding of an electric voltage carried by the conductor portion 20. Referring back to FIG. 1, it should be appreciated that the conductor is located between the terminal house 16 and the terminal axis 30. When the electric connector assembly 10 is assembled, the conductor portion 20 may be contacted by an object inserted through the terminal opening 17. The illustrated plastic cap portion 24 is located within the terminal opening 17 and reduces the available space for an object to enter the terminal house 16. Therefore it reduces the size of objects that may inadvertently contact the conductor portion 20. Additionally, since the illustrated cap portion 24 is made of electrically non-conductive plastic, contact with the cap portion 24 will not cause unintended grounding.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric terminal assembly comprising:

a conductor portion including a conductor body and a plurality of contact arms extending from the conductor body in an axially outward direction to respective contact arm ends, the contact arms located around a terminal axis;

a cap portion fixed relative to the conductor portion, the cap portion defining a cap opening that the terminal axis extends through; and a spring portion connected to the conductor portion, the spring portion including a spring body and a plurality of spring arms that extend from the spring body and engage the contact arms and bias them toward the terminal axis, the spring portion further including a shroud that is connected to the spring body, wherein the cap opening and the shroud are located farther from the conductor body in the axially outward direction than the contact arm ends, the cap portion is connected to the shroud, and the cap portion includes a plurality of cap guides with cap guide surfaces that engage the shroud.

2. The electric terminal assembly of claim 1, wherein the cap opening is defined by a cap body, and the cap guides extend from the cap body opposite the outward direction.

3. The electric terminal assembly of claim 1, wherein the cap portion includes a plurality of cap mounts that retain the cap portion on the shroud.

4. The electric terminal assembly of claim 1, wherein the cap portion includes a plurality of cap guides that extend from the cap portion opposite the outward direction to respective guide ends that are closer to the conductor body in the outward direction than the contact arm ends.

5. An electric terminal assembly comprising:

a conductor portion including a conductor body and a plurality of contact arms that extend in an axially outward direction from the conductor body to respective contact arm ends, wherein the plurality of contact arms is disposed about a terminal axis;

a spring portion including a spring body that is supported on the conductor portion a plurality of spring arms that engage the contact arms of the conductor portion and bias them toward the terminal axis, and a shroud that is connected to the spring body; and a cap portion that is supported on the shroud of the spring portion and defines a cap opening through which the terminal axis extends, wherein the cap opening is located farther from the conductor body in the axially outward direction than the contact arm ends, and wherein either:

(1) the cap portion includes a plurality of cap guides with cap guide surfaces that engage the shroud;

(2) the cap portion includes a plurality of cap mounts that retain the cap portion on the shroud; or (3) the cap portion includes a plurality of cap guides that extend from the cap portion opposite the outward direction to respective guide ends that are closer to the conductor body in the outward direction than the contact arm ends.

6. The electric terminal assembly of claim 5, wherein the cap portion includes a plurality of cap guides with cap guide surfaces that engage the shroud.

7. The electric terminal assembly of claim 6, wherein the cap opening is defined by a cap body, and the cap guides extend from the cap body opposite the outward direction.

8. The electric terminal assembly of claim 5, wherein the cap portion includes a plurality of cap mounts that retain the cap portion on the shroud.

9. The electric terminal assembly of claim 5, wherein the cap portion includes a plurality of cap guides that extend from the cap portion opposite the outward direction to respective guide ends that are closer to the conductor body in the outward direction than the contact arm ends.

10. An electric terminal assembly comprising:

a conductor portion including a conductor body and a plurality of contact arms extending from the conductor body in an axially outward direction to respective contact arm ends, the contact arms located around a terminal axis;

a cap portion fixed relative to the conductor portion, the cap portion defining a cap opening that the terminal axis extends through; and a spring portion connected to the conductor portion, the spring portion including a spring body and a plurality of spring arms that extend from the spring body and engage the contact arms and bias them toward the terminal axis, the spring portion further including a shroud that is connected to the spring body, wherein the cap portion is located farther from the conductor body in the axially outward direction than any portion of the contact arms, the cap portion is connected to the shroud, and the cap portion includes a plurality of cap guides with cap guide surfaces that engage the shroud.

11. The electric terminal assembly of claim 1, wherein each of the cap guide surfaces has an arcuate shape.

12. The electric terminal assembly of claim 6, wherein each of the cap guide surfaces has an arcuate shape.

13. The electric terminal assembly of claim 10, wherein each of the cap guide surfaces has an arcuate shape.

14. The electric terminal assembly of claim 1, wherein the cap portion includes a plurality of cap mounts that retain the cap portion on the shroud.

15. The electric terminal assembly of claim 10, wherein the cap portion includes a plurality of cap mounts that retain the cap portion on the shroud.

* * * * *